US006820534B1

(12) United States Patent
Schooler

(10) Patent No.: US 6,820,534 B1
(45) Date of Patent: Nov. 23, 2004

(54) RECIPROCATING CYLINDER

(76) Inventor: Paul Schooler, 16285 Erin, Fraser, MI (US) 48026

( * ) Notice: Subject to any disclaimer, the term of this patent is extended or adjusted under 35 U.S.C. 154(b) by 0 days.

(21) Appl. No.: 10/795,852

(22) Filed: Mar. 8, 2004

(51) Int. Cl.[7] ..... F15B 15/22
(52) U.S. Cl. ..... 91/395
(58) Field of Search ..... 91/395

(56) References Cited

U.S. PATENT DOCUMENTS 2,786,452 A * 3/1957 Tucker ..... 91/395
3,027,876 A * 4/1962 Strick ..... 91/395

* cited by examiner

*Primary Examiner*—F. Daniel Lopez
(74) *Attorney, Agent, or Firm*—Carlson, Gaskey & Olds

(57) ABSTRACT

A piston chamber assembly has a chamber and a piston slideably received in the chamber. The piston has a first side and a second side. A first inlet communicates air into the chamber on the first side while a second inlet communicates air into the chamber on the second side. An actuator is moveable between a first position and a second position. The actuator selectively opens and closes the first inlet and the second inlet. In the first position, the actuator closes the second inlet and opens a first inlet while in the second position the actuator opens the second inlet and closes the first inlet. The actuator is coupled to the piston, which drives the actuator between the first position and the second position.

13 Claims, 3 Drawing Sheets

RECIPROCATING CYLINDER

BACKGROUND OF THE INVENTION

This invention relates to a cylinder and piston assembly.

Automotive manufacturers generally test vehicle components, such as a vehicle door, by simulating the operating conditions of the vehicle component. For example, to test the functioning of a door, the manufacturer may repeatedly open and close the door to test wear and tear. Frequently, this action is performed by a piston and cylinder, which opens and closes the door.

The cylinder is connected to an air compressor while the piston is connected by a rod to the test component. Air to the piston and cylinder is controlled by a computer. The computer directs air from the compressor to one side of the piston to move the piston and rod in one direction. When the piston has moved to one side of the cylinder, the computer then directs air to the opposite side of the piston to thereby move the piston and rod in the other direction. This cycle is repeated.

The task performed by the piston and cylinder is simple. However, a computer is still used to control the assembly's operation. The computer adds significant expense to the testing of the component. A need therefore exists for a piston and cylinder that cycles without a computer.

SUMMARY OF THE INVENTION

The invention comprises a piston and cylinder assembly. Like existing designs, the invention has a piston that is slideably received in a chamber of the cylinder. On one side of the piston is one air inlet while on the other side of the piston is a second air inlet. In contrast to conventional assemblies, the invention has an actuator within the chamber that is moveable between a first position and a second position. In the first position, the actuator opens the first inlet and closes the second. In the second position, the actuator closes the first inlet and opens the second.

The actuator is coupled to the piston, which drives the actuator between the first position and the second position. Accordingly, air entering the cylinder on the first side of the piston expands the piston and thereby moves the actuator to close the first inlet and open the second inlet. Air in the second inlet is then allowed to expand the piston and move the actuator so as to close the second inlet and again permit air through the first inlet. In this way, the inventive assembly cycles without the need of a computer.

The actuator may comprise a body in the chamber of the cylinder. The body may move in one direction towards the first position and in another direction towards the second position. The piston is arranged to impart its momentum to the body in either direction. In this way, the body moves between the first position and the second position.

The actuator may further have a first portion and a second portion. The piston may be supported to move between the first portion and the second portion alternatingly in one direction and the other direction. The actuator thereby imparts its momentum to either the first portion or the second portion. The first portion may close the first inlet in the second position while the second portion closes the second inlet in the first position.

The invention further has a retaining feature that holds the actuator in either the first position or the second position until a predetermined amount of momentum is received by the actuator. This feature may comprise a magnet. In this way, the actuator stays in its position until sufficient momentum is imparted by the piston. This feature thereby avoids movement of the actuator with the piston until sufficient momentum has been received by the actuator to move between positions.

Another version of the invention uses a different actuator. The actuator has a member that is rotated by the piston between a first position and a second position. The rotating actuator has a first portion and a second portion. The first portion has a first opening that permits air from the first inlet into the chamber while the second portion has a second opening that permits air from the second inlet into the chamber. When the piston has reached a certain position on the member, the member rotates to close the first inlet and open the second inlet. The member is then subsequently rotated by the piston to close the second inlet when the first inlet is opened.

The piston slides relative to this rotating actuator. The actuator has a cam that is selectively in contact with the piston. The action of the piston on the cam rotates the actuator between the first position and the second position. The piston may further be mounted to a groove on the actuator. The cam may be part of the groove.

Both features permit the inventive assembly to cycle by itself. There is no need for a computer to control air flow into the piston chamber. The invention is therefore much cheaper to produce.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
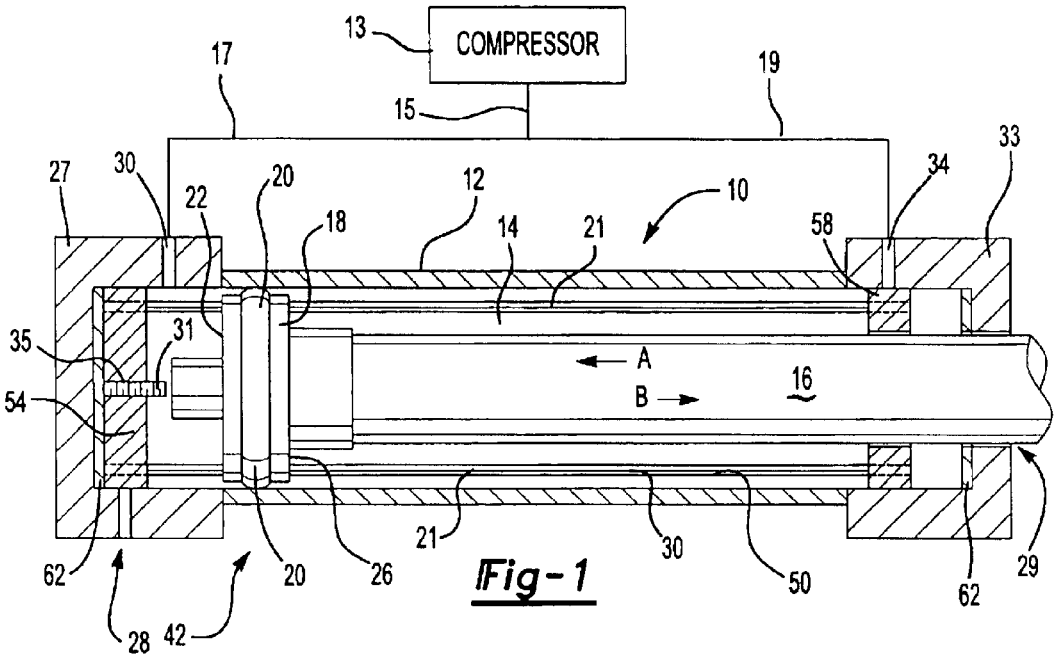
FIG. 1 illustrates a cross-sectional view of the inventive assembly in the first position with the first inlet open and the second inlet closed.

FIG. 1 illustrates a cross-sectional view of an inventive piston chamber assembly 10. Piston chamber assembly 10 has piston 18 and chamber 14, defined by cylinder 12. Piston 18 has first side 22 and second side 26. On first side 22 of piston 18, there is provided first inlet 30 that permits the passage of air from compressor 13 through line 17 onto first side 22 of piston 18. In addition, piston chamber assembly 10 has second inlet 34, which permits air from compressor 13 through line 19 to pass onto second side 26 of piston 18. Here, piston 18 is attached to rod 16, which may be attached to a test piece.

In contrast to conventional designs, piston chamber assembly 10 has actuator 38 disposed within chamber 14.

Actuator 38 has body 50, which has first portion 54 on first side of piston 18 and second portion 58 on second side 26 of piston 18. First portion 54 and second portion 58 are slideably received within chamber 14. In addition, first portion 54 and second portion 58 are connected by rods 21 so that they may slide together within chamber 14.

Piston 18 is also slideably received on rods 21 between first portion 54 and second portion 58. Piston 18 further has seal 20, here an O-ring, that serves to wipe chamber 14 as well as to provide a seal between first side 22 and second side 26 of piston 18. Piston chamber assembly 10 further has exhaust outlet 28 on first side 22 of piston 18 and exhaust outlet 29 on second side 26 of piston 18. Exhaust outlet 29 is merely a gap between rod 16 and end portion 33 of cylinder 12.

Figure 2:
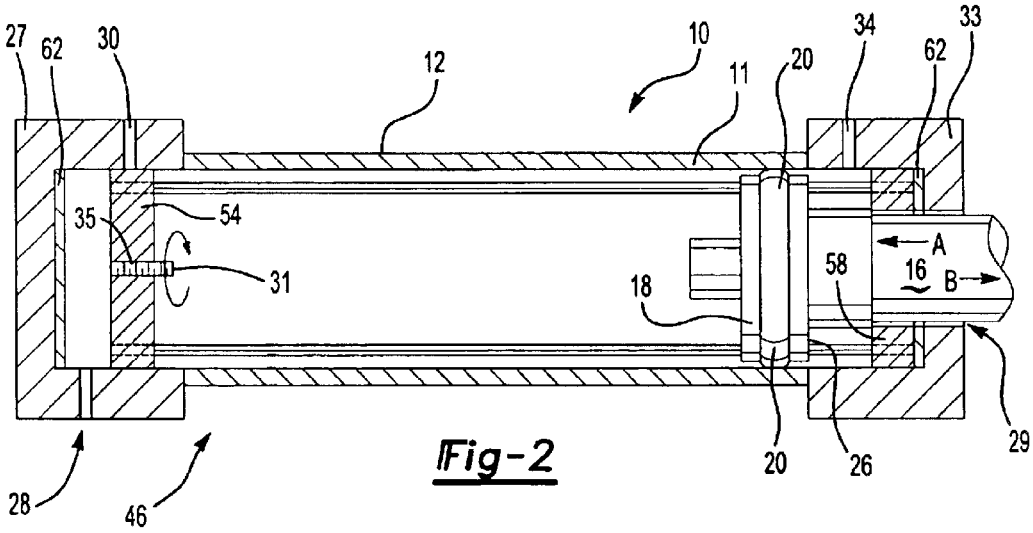
FIG. 2 illustrates the assembly of FIG. 1 in the second position with the second inlet open and the first inlet closed.

The operation of piston chamber assembly 10 will now be explained with reference to FIGS. 1 and 2. FIG. 1 illustrates piston chamber assembly 10 with actuator 38 in first position 42. As shown, first portion 54 is in a position to cover exhaust outlet 28. Moreover, second portion 58 is in a position to cover second inlet 34. Retaining feature 62, here a magnetic plate, holds first portion 54 in first position 42. First portion 54 and second portion 58 are both attractable by magnet of retaining feature 62.

In first position 42, air passes from compressor 13 through line 15 and splits into line 17 and line 19. Because first inlet 30 is open to receive air on first side 22 of piston 18 and second inlet 34 is closed due to the position of second portion 58 in first position 42, piston 18 expands in the direction of arrow B moving rod 16 in the same direction. Piston 18 develops momentum and impacts second portion 58 as shown in FIG. 2. This collision between second portion 58 and piston 18 causes first portion 54 to become dislodged from retaining feature 62 and to move to second position 46, where second portion 58 is held in place by the other retaining feature 62.

In this second position 46, actuator 38 now allows air to pass from line 19 through second inlet 34 onto second side 26 of piston 18. Moreover, first inlet 30 is closed so that air from compressor 13 will not enter into chamber 14 on first side 22 of piston 18. Exhaust 28 is also open to permit air on first side 22 to escape. Air passes through second inlet 34 to cause piston 18 and rod 16 to move in the direction of arrow A. Piston 18 then develops momentum and comes into contact with first portion 54 to thereby drive first portion 54 back to first position 42 shown in FIG. 1. Piston chamber assembly 10 may cycle back and forth in manner indefinitely. It is preferable for piston 18 to be made of a material having a low coefficient of friction, preferably, DuPont's DERLIN™ ring material.

Piston chamber assembly 10 has adjuster 31. Adjuster 31 comprises a set screw, which may be turned to move adjuster 31 in the direction of arrow A or B. Stroke adjuster 31 is threadedly received by first portion 54 and moves with first portion 54. By turning the screw, adjuster 31 may adjust the position of piston 18 within chamber 10 relative to end portion 27 so as to prevent piston 18 from covering first inlet 30 in first position 42.

Figure 3:
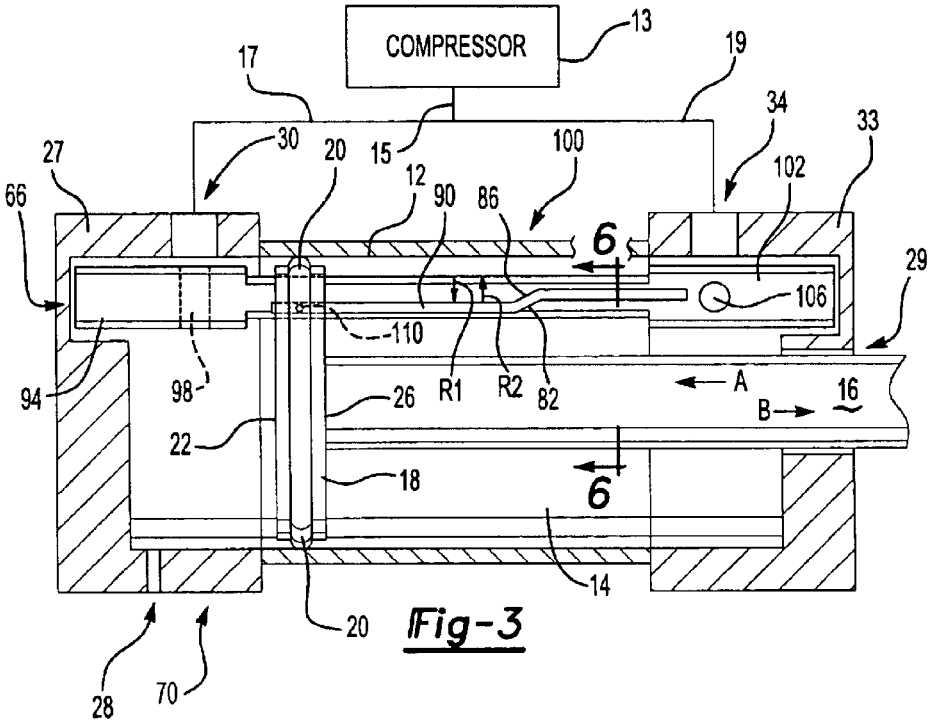
FIG. 3 illustrates a cross-sectional view of another version of the invention in the first position with the first inlet open and the second inlet closed.
Figure 4:
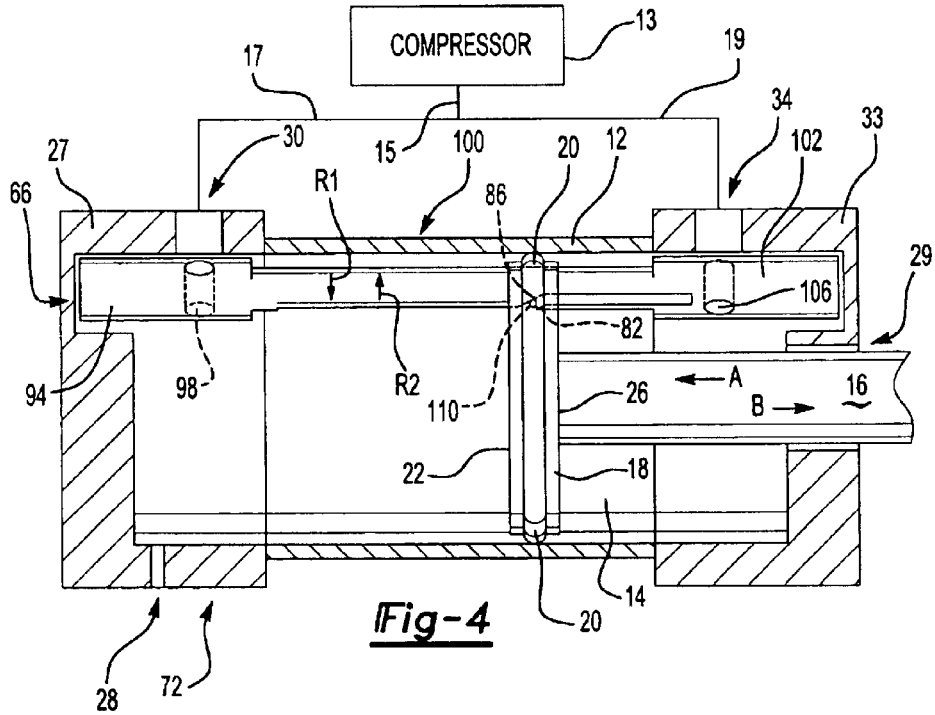
FIG. 4 illustrates a cross-sectional view of the inventive assembly of FIG. 3 at the point in which the actuator switches between the first position and the second position.
Figure 5:
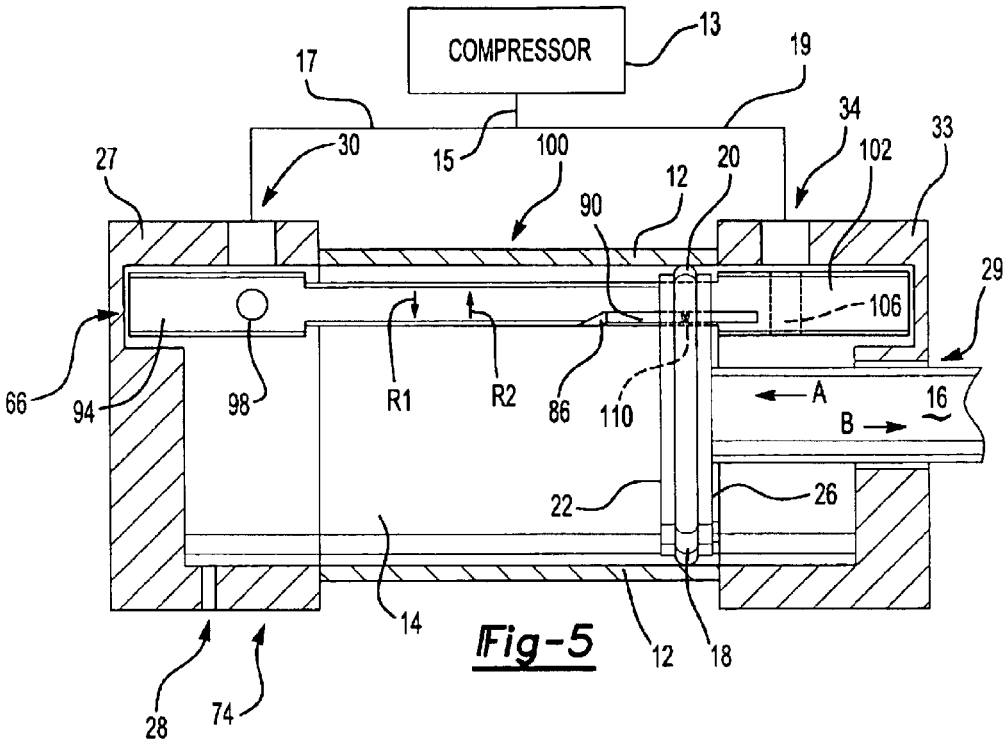
FIG. 5 illustrates the assembly of FIGS. 3 and 4 in the second position with the second air inlet open and the first inlet closed.

FIGS. 3–5 illustrate another version of the inventive piston chamber assembly. Here, piston chamber assembly 100 comprises chamber 14 having piston 18 slideably received within chamber 14. Piston 18 has first side 22 and second side 26. In addition, piston 18 has seal 20. Chamber 14 is provided with first inlet 30 and second inlet 34 as well as exhaust outlet 28 and exhaust outlet 29. These features are identical to the features identified by the same numbers in FIG. 1.

Unlike the previous version, actuator 66 here comprises a member rotatably mounted to end portion 27 and 33 of cylinder 12. Actuator 66 may rotate in the direction of arrow $R_1$ or in the direction of arrow $R_2$. Actuator 66 further has first portion 94 with first opening 98 and second portion 102 with second opening 106. As shown in the figures, first opening 98 extends through actuator 66 in a transverse direction relative to second opening 106. Accordingly, as shown in FIG. 3, when actuator 66 is in first position 70, first opening 98 permits air to pass through first inlet 30 while second opening 106 is blocked by second portion 102. Conversely, as shown in FIG. 5, if actuator 66 is rotated in the direction of arrow $R_1$, first opening 98 is rotated so that it is no longer aligned with first inlet 30. Consequently, first portion 94 blocks first inlet 30 while second opening 106 is now aligned with second inlet 34 to permit air to pass to second side 26 of piston 18.

Figure 6:
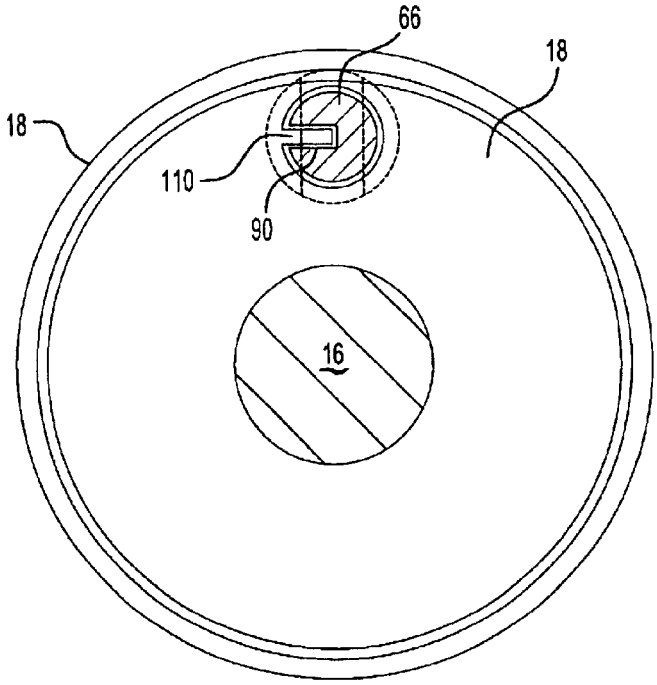
FIG. 6 illustrates a view of the piston and actuator of FIG. 3-5.

Like the previous version, piston 18 is mechanically linked to actuator 66. As shown in FIG. 6, piston 18 is slideably received on actuator 66. Piston 18 and actuator 66 are mechanically linked by pin 110. Pin 110 extends from piston 18 into groove 90. As shown in FIG. 4, groove 90 further has first cam 82 and second cam 86, both of which define a portion of groove 90.

The functioning of actuator 66 will now be explained with reference to FIGS. 3–5. As shown in FIG. 3, actuator 66 is in a position to permit air from line 17 to pass through first inlet 30 and through first opening 98 to first side 22 of piston 18. Second opening 106 is blocked by second portion 102. Air then expands piston 18 in the direction of arrow B. As shown in FIG. 4, pin 110 contacts first cam 18 as piston 18 slides to intermediate position 72. This contact of pin 110 with cam 82 causes actuator 66 to rotate in the direction of arrow $R_1$, here downward.

As shown in FIG. 5, when actuator 66 has rotated to second position 74, actuator 66 now is in a position to block first inlet 30 because first opening 98 has rotated out of alignment with first inlet 30. In addition, second opening 106 is now aligned with second inlet 34 to allow air to pass from line 19 to second side 26 of piston 18. Piston 18 then expands in the direction of arrow A. Pin 110 moves along groove 90 so as to come in contact with cam 86 and thereby rotate actuator 66 in the upward direction of arrow $R_2$. Consequently, actuator 66 then rotates back to first position 70 as shown in FIG. 3.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A piston chamber assembly comprising:

a chamber;

a piston slideably received in said chamber, said piston having a first piston side and a second piston side;

a first inlet for communicating a fluid into said chamber on said first piston side;

a second inlet for communicating a fluid into said chamber on said second piston side;

an actuator movable between a first position and a second position, said actuator for selectively opening said first inlet and closing said second inlet when in said first position and said actuator for selectively closing said first inlet and opening said second inlet when in said second position wherein said piston is coupled to drive said actuator between said first position and said second position;

said actuator comprising a body in said chamber, said body selectively movable between a first direction towards said first position and a second direction towards said second position;

said piston arranged to impart momentum to said actuator selectively between said first direction and said second direction, thereby moving said actuator between said first position and said second position;

said actuator comprising a first portion and a second portion, said piston supported to move between said first portion and said second portion alternating in said first direction and said second direction to impart momentum to one of said first portion and said second portion;

said first portion closing said first inlet in said second position and said second portion closing said second inlet in said first position; and a retaining feature for maintaining said actuator in one of said first position and said second position until a predetermined amount of momentum is received by said actuator.

2. The piston chamber assembly of claim 1 wherein said retaining feature comprises a magnet.

3. A piston chamber assembly comprising:

a chamber;

a piston slideably received in said chamber, said piston having a first piston side and a second piston side;

a first inlet for communicating a fluid into said chamber on said first piston side:

a second inlet for communicating a fluid into said chamber on said second piston side;

an actuator movable between a first position and a second position, said actuator for selectively opening said first inlet and closing said second inlet when in said first position and said actuator for selectively closing said first inlet and opening said second inlet when in said second position wherein said piston is coupled to drive said actuator between said first position and said second position; and said actuator comprising a member rotatable by said piston between said first position and said second position.

4. The piston chamber assembly of claim 3 wherein said piston is slideable relative to said member.

5. The piston chamber assembly of claim 4 wherein said member has a cam selectively in contact with said piston to rotate said member between said first position and said second position.

6. The piston chamber assembly of claim 5 wherein said piston is slideably mounted to a groove in said member, said cam defining a portion of said groove.

7. The piston chamber assembly of claim 3 wherein said member has a fist portion with a first opening for communicating fluid from said first inlet into said chamber on said first piston side when said actuator is in said first position and a second portion with a second opening for communicating fluid from said second inlet into said chamber on said second piston side when said actuator is in said second position.

8. The piston chamber assembly of claim 7 wherein said first portion close said first inlet in said second position and said second portion closing said second inlet in said first position.

9. A piston chamber assembly comprising:

a chamber;

a piston slideably received in said chamber, said piston having a first piston side and a second piston side;

a first inlet for communicating a fluid into said chamber on said first piston side;

a second inlet for communicating a fluid into said chamber on said second piston side;

an actuator movable between a first position and a second position, said actuator for selectively opening said first inlet and closing said second inlet when in said first position and said actuator for selectively closing said first inlet and opening said second inlet when in said second position wherein said piston is coupled to drive said actuator between said first position and said second position;

wherein said actuator comprises a member in said chamber, said member selectively rotatable between a first direction towards said first position and a second direction towards said second position; and wherein said piston is arranged to impart momentum to said actuator selectively between said first direction and said second direction, thereby moving said actuator between said first position and said second position.

10. The piston chamber assembly of claim 9 wherein said piston is slideable relative to said member.

11. The piston chamber assembly of claim 10 wherein said member has a cam selectively in contact with said piston to rotate said member between said first position and said second position.

12. The piston chamber assembly of claim 11 wherein said piston is slideably mounted to a groove in said member, said cam defining a portion of said groove.

13. The piston chamber assembly of claim 9 wherein said member has a first portion with a first opening for communicating fluid from said first inlet into said chamber on said first piston side when said actuator is in said first position and a second portion with a second opening for communicating fluid from said second inlet into said chamber on said second piston side when said actuator is in said second position.

* * * * *

UNITED STATES PATENT AND TRADEMARK OFFICE

CERTIFICATE OF CORRECTION

PATENT NO. : 6,820,534 B1
DATED : November 23, 2004
INVENTOR(S) : Schooler

It is certified that error appears in the above-identified patent and that said Letters Patent is hereby corrected as shown below:

Column 6,
Line 2, “fist” should read as -- first --.
Line 10, “close” should read as -- closes --.

Signed and Sealed this

Fifteenth Day of February, 2005

JON W. DUDAS
*Director of the United States Patent and Trademark Office*